US006292149B1

(12) United States Patent
Endo et al.

(10) Patent No.: US 6,292,149 B1
(45) Date of Patent: Sep. 18, 2001

(54) ALL-AROUND VEHICLE ANTENNA APPARATUS

(75) Inventors: Hiroshi Endo, Tokyo; Masatoshi Saito, Machida; Hiroyuki Tachihara, Chiba-ken, all of (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 09/132,655

(22) Filed: Aug. 12, 1998

(30) Foreign Application Priority Data

Aug. 19, 1997 (JP) ..... 9-222360

(51) Int. Cl.[7] ..... H01Q 1/32

(52) U.S. Cl. ..... 343/713; 343/711; 343/767; 343/770

(58) Field of Search ..... 343/711, 712, 343/713, 767, 768, 770

(56) References Cited

U.S. PATENT DOCUMENTS 5,646,637 * 7/1997 Miller ..... 343/713
5,739,794 * 4/1998 Nagy et al. ..... 343/713
5,831,580 * 11/1998 Taniguchi et al. ..... 343/713
5,898,407 4/1999 Paulus et al. ..... 343/713
6,002,373 * 12/1999 Taniguchi et al. ..... 343/713

FOREIGN PATENT DOCUMENTS 0375415 6/1990 (EP) .
0643437 3/1995 (EP) .
0760537 3/1997 (EP) .

* cited by examiner

*Primary Examiner*—Don Wong
*Assistant Examiner*—Shih-Chao Chen
(74) *Attorney, Agent, or Firm*—Volpe and Koenig, P.C.

(57) ABSTRACT

In an all-around vehicle antenna apparatus according to the present invention, a window frame of a vehicle window is made of metal, a thin-film conductor is formed on the surface of a translucent member (e.g., glass) of the vehicle window to form a slot between the window frame and thin-film conductor, and the slot functions as a slot antenna element. A plurality of thin-film conductor pieces are arranged such that at least part of the pieces is inserted into the slot so as to have a specific relationship with the slot antenna element, and thus the thin-film conductor pieces serve as a plural-wave-receivable antenna element adapted to a specific frequency.

6 Claims, 2 Drawing Sheets

ALL-AROUND VEHICLE ANTENNA APPARATUS

BACKGROUND OF THE INVENTION

The present invention relates to an all-around vehicle antenna apparatus mounted on a vehicle such as an automobile and, more particularly, to an improvement in an antenna apparatus constituted mainly of a slot antenna provided on a vehicle window.

In a conventional windowpane antenna apparatus provided on a vehicle window, a long, narrow thin-film conductor having a predetermined pattern, which is to be formed on the window surface, is used as an antenna element. This antenna element is connected to a transmitter/receiver set via a feeder.

Since, in the windowpane antenna apparatus, a metal window frame serves as a grounding conductor, its shape has influence upon antenna characteristics. Usually the shape of a metal window frame greatly varies from vehicle to vehicle; therefore, even though an antenna element is formed with great precision so as to have a given size and a given shape, the antenna characteristics are greatly varied with the type of a vehicle on which the antenna element is to be mounted, with the result that a desired antenna characteristic cannot be obtained appropriately. To mount the above windowpane antenna apparatus on a vehicle, it is necessary to form a pattern for each antenna element in order to match the shape of a window frame of every vehicle, thus causing a drawback of making it difficult to manufacture the antenna element, and increasing in manufacturing costs.

BRIEF SUMMARY OF THE INVENTION

It is accordingly an object of the present invention to provide an all-around vehicle antenna apparatus, which is capable of always stably fulfilling a desired antenna characteristic without exerting no influence upon the shape of a window frame though it has a fixed size and a fixed shape and is provided on a vehicle window.

To attain the above object, the all-around vehicle antenna apparatus according to the present invention has the following structures. The other characteristic structures will be clarified later in the embodiment of the present invention.

According to one aspect of the present invention, there is provided an all-around vehicle antenna apparatus, which includes a first means for forming a slot antenna element in a vehicle window having a window frame in which a translucent member is fitted and a second means for forming a plural-wave-receivable antenna element having a specific relationship with the slot antenna element in the vehicle window, the first means comprising means for making the window frame of the vehicle window of metal, means for providing a thin-film conductor on the translucent member of the vehicle window to form a predetermined slot between the window frame and the thin-film conductor, and means for causing the slot to function as the slot antenna element, and the second means comprising means for arranging a plurality of thin-film conductor pieces such that at least part of the thin-film conductor pieces is inserted in the slot so as to have a specific relationship with the slot antenna element, and means for causing the plurality of thin-film conductor pieces to function as the plural-wave-receivable antenna element adapted to a specific frequency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

Embodiment

Figure 1:
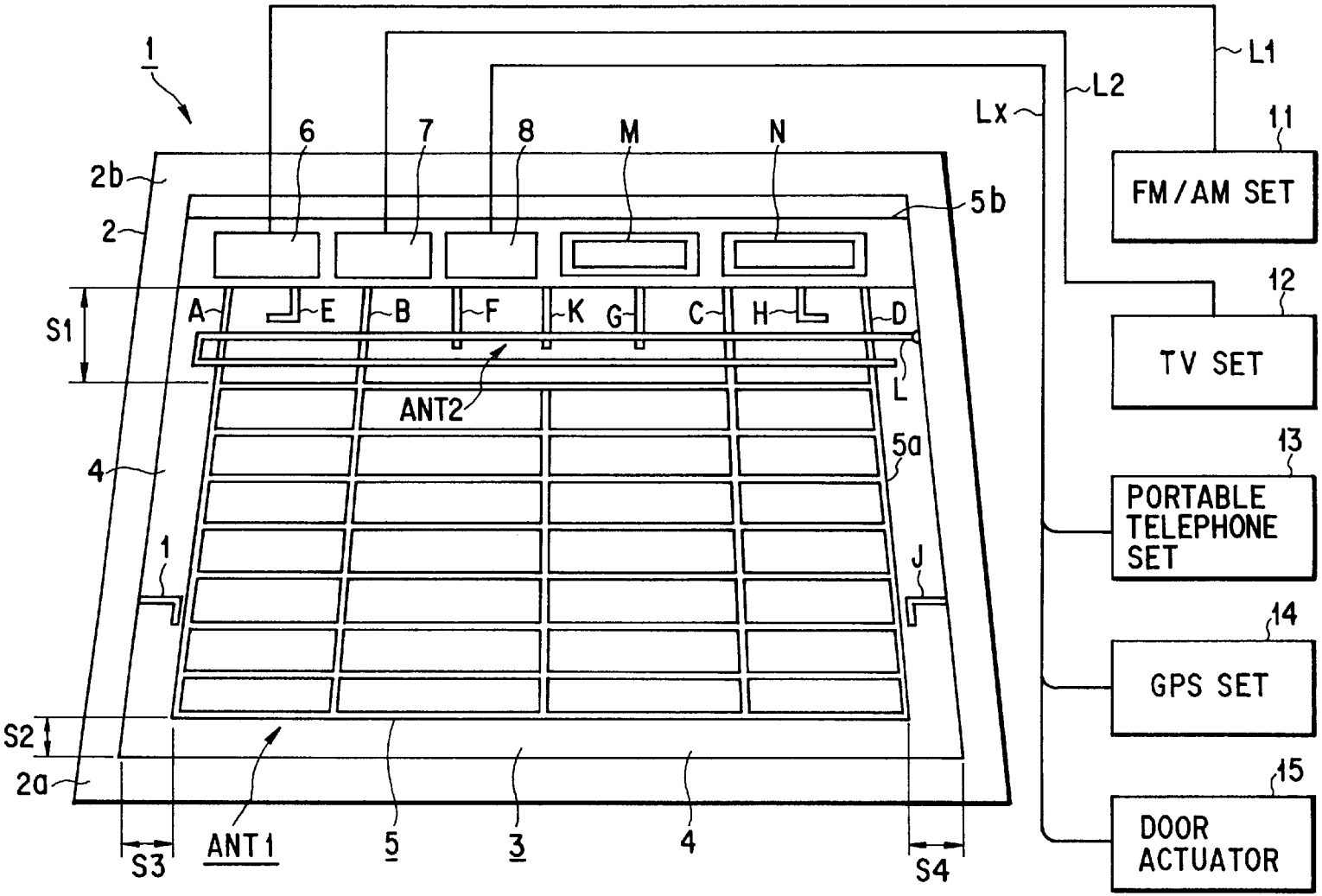
FIG. 1 is a view of the structure of an all-around vehicle antenna apparatus according to one embodiment of the present invention.
Figure 2:
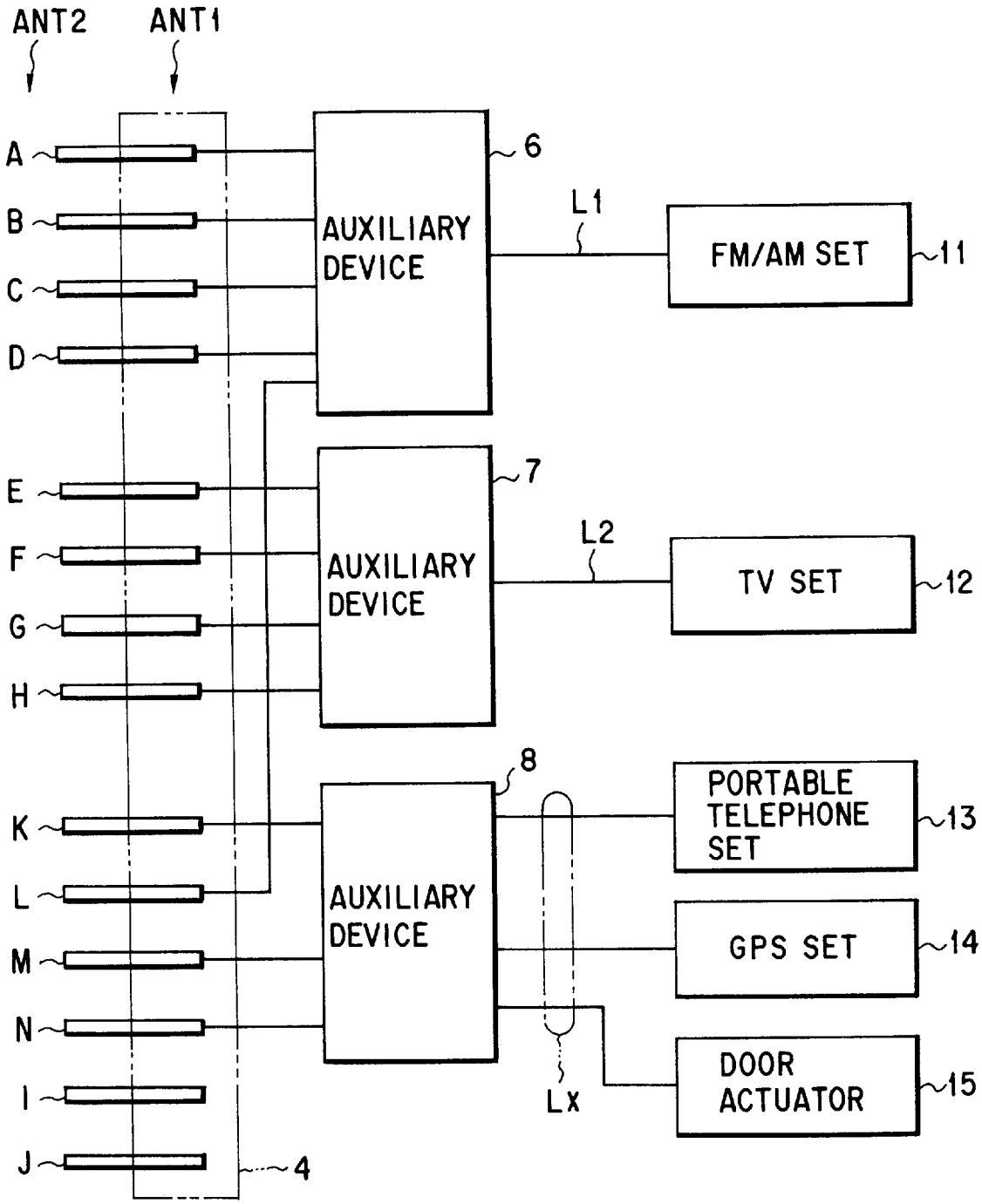
FIG. 2 is a block diagram of an electric system of the all-around vehicle antenna apparatus shown in FIG. 1.

Referring to FIGS. 1 and 2, one embodiment of the present invention will now be described. In FIG. 1, reference numeral 1 denotes a rear window of a vehicle. The window 1 has a window frame 2 made of metal and a translucent member 3 formed of a windowpane or the like. A thin-film conductor 5 is provided on the surface of the translucent member 3. A slot 4 having a predetermined width is formed between the window frame 2 and thin-film conductor 5.

The thin-film conductor 5 is constituted mainly of a defogger 5*a* for preventing the rear window 1 from being fogged. Between the defogger 5*a* and an upper frame 2*b* of the window frame 2, a relatively broader belt-shaped conductor 5*b* is formed in parallel with the upper frame 2*b*. The width S1 of the upper edge of the slot 4 between the defogger 5*a* and belt-shaped conductor 5*b*, is set to about 4 cm, while the width S2 of the lower edge thereof and the widths S3 and S4 of both sides thereof are each set to about 1 cm to 2 cm. Thus, a slot antenna element ANT1 mainly including the slot 4 is formed on the surface of the rear window 1.

A plurality of thin-film conductor pieces A to H, K and L are arranged in such a manner that at least part of the pieces is inserted in the slot 4 so as to have a specific relationship with the slot antenna element ANT1. Of these thin-film conductor pieces, the pieces A to D are directly connected to the defogger 5*a* and supplied with power, and the pieces E to H, K and L are electrostatically coupled to the defogger 5*a* and supplied with power. Thus, each of the conductor pieces A to H, K and L functions as a plural-wave-receivable antenna element ANT2 adapted to a specific frequency.

In the foregoing embodiment, the thin-film conductor pieces A to D constitute a 4-channel FM antenna element, and the thin-film conductor pieces E to H constitute a 4-channel TV antenna element. Moreover, the piece K constitutes a key-less door lock/unlock antenna element, and the piece L constitutes an AM antenna element.

Small-sized slot antenna elements M and N adapted to a specific frequency are formed on the belt-shaped conductor 5*b*. The antenna element M constitutes a 1.5 GHz GPS (Global Positioning System) antenna element, and the antenna element N constitutes an 800 MHz portable telephone antenna element.

The belt-shaped conductor 5*b* is provided with auxiliary devices 6, 7 and 8 including an amplifier circuit for amplifying a signal input to the antenna apparatus and a matching circuit. The antenna elements constituted of thin-film conductor pieces are connected to their respective transmitter/receiver sets via the auxiliary devices 6, 7 and 8. For example, the thin-film conductor pieces A to D for the FM antenna element and the thin-film conductor piece L for the AM antenna element are connected to an FM/AM set 11 through the auxiliary device 6 and line L1. Similarly, the thin-film conductor pieces E to H for the TV antenna element are connected to a TV set 12 through the auxiliary device 7 and line L2. The other antenna elements, i.e., the small-sized slot antenna elements M and N serving as the GPS antenna element and the portable telephone antenna element, respectively, and the thin-film conductor piece K for the key-less door lock/unlock antenna element, are connected to a portable telephone set 13, a GPS set 14, and a door actuator 15 through the auxiliary device 8 and line Lx.

Matching elements I and J of slot antenna element ANT1 are inserted in the slot 4 between the window frame 2 and thin-film conductor 5. If the matching elements I and J are adjusted in advance, the impedance matching of the slot antenna element ANT1 can be obtained.

Features of the Invention

[1] An all-around vehicle antenna apparatus according to the embodiment of the present invention includes a first means for forming a slot antenna element ANT1 in a vehicle window 1 having a window frame 2 in which a translucent member 3 is fitted and a second means for forming a plural-wave-receivable antenna element ANT2 having a specific relationship with the slot antenna element ANT1 in the vehicle window 1.

The first means comprises:

means for making the window frame 2 of the vehicle window 1 of metal;

means for providing a thin-film conductor 5 on the translucent member 3 of the vehicle window 1 to form a predetermined slot 4 between the window frame 2 and the thin-film conductor 5; and means for causing the slot 4 to function as the slot antenna element ANT1.

The second means comprises:

means for arranging a plurality of thin-film conductor pieces A to H, K and L such that at least part of the thin-film conductor pieces is inserted in the slot 4 so as to have a specific relationship with the slot antenna element ANT1; and means for causing the plurality of thin-film conductor pieces A to H, K and L to function as the plural-wave-receivable antenna element ANT2 adapted to a specific frequency.

[2] In the all-around vehicle antenna apparatus as described in the above item [1], the slot antenna element ANT1 has matching elements I and J between the window frame 2 and the thin-film conductor 5.

[3] In the all-around vehicle antenna apparatus as described in the above item [1], the plural-wave-receivable antenna element ANT2 constituted of the thin-film conductor pieces A to H, K and L includes FM antenna elements A to D having a plurality of channels, TV-antenna elements E to H having a plurality of channels, a key-less door lock/unlock antenna element K, and an AM antenna element L.

[4] In the all-around vehicle antenna apparatus as described in the above item [1], the thin-film conductor 5 is constituted of a defogger 5*a*.

[5] In the all-around vehicle antenna apparatus as described in the above item [4], a belt-shaped conductor 5*b* is formed in parallel with the window frame 2 between the window frame 2 and the-defogger 5*a*.

[6] In the all-around vehicle antenna apparatus as described in the above item [5], the belt-shaped conductor 5*b* is provided with auxiliary devices 6, 7 and 8 such as an amplifier circuit.

[7] In the all-around vehicle antenna apparatus as described in the above item [5], the belt-shaped conductor 5*b* is provided with small-sized slot antenna elements M and N adapted to a specific frequency.

[8] In the all-around vehible antenna apparatus as described in the above item [7], the small-sized slot antenna elements M and N includes a portable telephone antenna element and a GPS antenna element.

Additional advantages and modifications will readily occurs to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. An all-around vehicle antenna apparatus comprising:

a vehicle window having a metal window frame in which a translucent member is fitted;

a defogger for defogging the vehicle window, the defogger being provided on the translucent member of the vehicle window with a gap serving as a slot having a width between an outer circumference of the defogger and an inner circumference of the metal window frame;

first means for causing the slot to function as a slot antenna element;

a plurality of thin-film conductor pieces arranged in such a manner that at least part of each conductor piece is inserted into the slot;

second means for causing the plurality of thin-film conductor pieces to function as plural-wave-receivable antenna elements having a specific relationship with the slot antenna element and excited in response to radio waves of plural specific frequencies; and a straight, belt-shaped thin-film conductor formed between an upper side of the defogger and an upper side of the metal window frame and in parallel with the upper side of the metal window frame wherein the straight, belt-shaped thin-film conductor includes a plurality of small-sized slot antenna elements excited in response to a radio wave having a specific frequency.

2. The all-around vehicle antenna apparatus according to claim 1, wherein the second means feeds power to the plurality of thin-film conductor pieces when the second means is electrically connected to the defogger, and connects a specific one or some of the thin-film conductor pieces to a corresponding transmit/receive set.

3. The all-around vehicle antenna apparatus according to claim 1, wherein the plural-wave-receivable antenna elements include an FM antenna element having a plurality of channels, a TV antenna element having a plurality of channels, a key-less door lock/unlock antenna element, and an AM antenna element.

4. The all-around vehicle antenna apparatus according to claim 1, wherein the slot includes a thin-film conductor piece for impedance-matching of the slot antenna element.

5. The all-around vehicle antenna apparatus according to claim 1, wherein the plurality of small-sized slot antenna elements include at least a portable telephone antenna element and a GPS antenna element.

6. An all-around vehicle antenna apparatus comprising:

a vehicle window having a metal window frame in which a translucent member is fitted;

a defogger for defogging the vehicle window, the defogger being provided on the translucent member of the vehicle window with a gap serving as a slot having a width between an outer circumference of the defogger and an inner circumference of the metal window frame;

first means for causing the slot to function as a slot antenna element;

a plurality of thin-film conductor pieces arranged in such a manner that at least part of each conductor piece is inserted into the slot;

second means for causing the plurality of thin-film conductor pieces to function as plural-wave-receivable antenna elements having a specific relationship with the slot antenna element and excited in response to radio waves of plural specific frequencies; and a straight, belt-shaped thin-film conductor formed between an upper side of the defogger and an upper side of the metal window frame and in parallel with the upper side of the metal window frame wherein the straight, belt-shaped thin-film conductor includes an auxiliary device having at least an amplifier circuit.

* * * * *